US005896939A

United States Patent [19]

Witte

[11] Patent Number: 5,896,939

[45] Date of Patent: Apr. 27, 1999

[54] DOWNHOLE MEASUREMENT OF DEPTH

[75] Inventor: Johannes Witte, Brunswick, Germany

[73] Assignee: Baker Hughes Incorporated, Houston, Tex.

[21] Appl. No.: 08/870,250

[22] Filed: Jun. 6, 1997

[30] Foreign Application Priority Data

Jun. 7, 1996 [EP] European Pat. Off. ..... 96109124

[51] Int. Cl.[6] ..... E21B 47/04

[52] U.S. Cl. ..... 175/40; 73/152.45

[58] Field of Search ..... 175/40, 61; 73/152.45, 73/152.44; 367/33, 83

[56] References Cited

U.S. PATENT DOCUMENTS

| | | | |
|---|---|---|---|
| 2,221,767 | 11/1940 | Hayward et al. | 175/40 |
| 3,504,370 | 3/1970 | Rebilly | 73/152.44 |
| 4,739,325 | 4/1988 | MacLeod | 340/854 |
| 4,976,143 | 12/1990 | Casso | 73/152.45 |
| 5,058,077 | 10/1991 | Twist | 367/25 |
| 5,230,387 | 7/1993 | Waters et al. | 175/45 |
| 5,274,552 | 12/1993 | Milburn | 73/152.44 |
| 5,341,886 | 8/1994 | Patton | 175/24 |
| 5,439,064 | 8/1995 | Patton | 175/24 |
| 5,581,024 | 12/1996 | Meyer, Jr. et al. | 73/152.03 |

FOREIGN PATENT DOCUMENTS 0449710 3/1991 European Pat. Off. .

*Primary Examiner*—Hoang C. Dang
*Attorney, Agent, or Firm*—Madan & Morris, PLLC

[57] ABSTRACT

The invention is a process and method for determination of the depth of a well during the process of drilling. A computer is housed in the drilling tool and pre-programmed with the data of the planned pattern of the borehole. Changes in the drilling mud pressure or flow of the drilling mud are detected by a downhole sensor and are used as a counter for the number of drilling string segments used. This, together with the known length of a drilling string segment, enables the computer to calculate the depth of the tool. The calculated depth is used by the computer to control the direction controlling device of the drilling tool.

18 Claims, 1 Drawing Sheet

DOWNHOLE MEASUREMENT OF DEPTH

CROSS REFERENCE TO RELATED APPLICATIONS

This application claims the benefit of the filing date of patent application Ser. No. 96109124.6 filed on Jun. 7, 1996 with the European Patent Office

FIELD OF THE INVENTION

The invention relates to a method and an apparatus for the underground ascertainment of the depth of a bore sunk in underground formations. The underground ascertainment of depth is important to the execution of drilling projects in which the directional pattern of the bore hole is programme-controlled on a basis of data acquired underground.

SUMMARY OF THE INVENTION

For the underground determination of depth, it is already known (U.S. Pat. No. 5,341,886) to equip the drilling tool used with a sensing wheel which as drilling proceeds runs over the walls of the bore hole and makes the distance travelled available as a measured value to a computer accommodated in the housing of the drilling tool and serving as a central processor. Alternatively, the depth can also be obtained by magnetic marking of the bore hole wall and recognising the marking by a magnetically sensitive measuring device. In this respect the magnetic marking device is accommodated in the housing of the drilling tool at a predetermined distance upstream of the measuring device in the direction of drilling. Response of the measuring device to a magnetic marking consequently takes place each time the predetermined distance between marking and measuring device is travelled.

The invention is concerned with the problem of providing a method and an apparatus for underground ascertainment of depth and which guarantee reliable functioning combined with considerable simplicity.

The invention resolves this problem by a method having the features set out in claim 1 and by an apparatus having the features set out in claim 6. For fiber development of the method, reference is made to claims 2 to 5.

With a simple sensor, the invention ascertains one of the typical variations in the drilling parameters during attachment of a tubular rod part to the drilling rod, so that in conjunction with a programme-related preset of the length measurement of the pipe rod parts used, the underground central processor can at brief intervals be provided with an updated and precise depth value such as is required for the programmed control of the drilling process. The manner in which this is done is extremely simple, operationally reliable and have a long effective life.

BACKGROUND OF THE INVENTION

The invention is explained in greater detail hereinafter with reference to the accompanying drawing which diagrammatically and by way of example shows a drilling device with a drilling tool and comprising a device for underground ascertainment of depth.

DETAILED DESCRIPTION OF THE INVENTION

Figure 1:
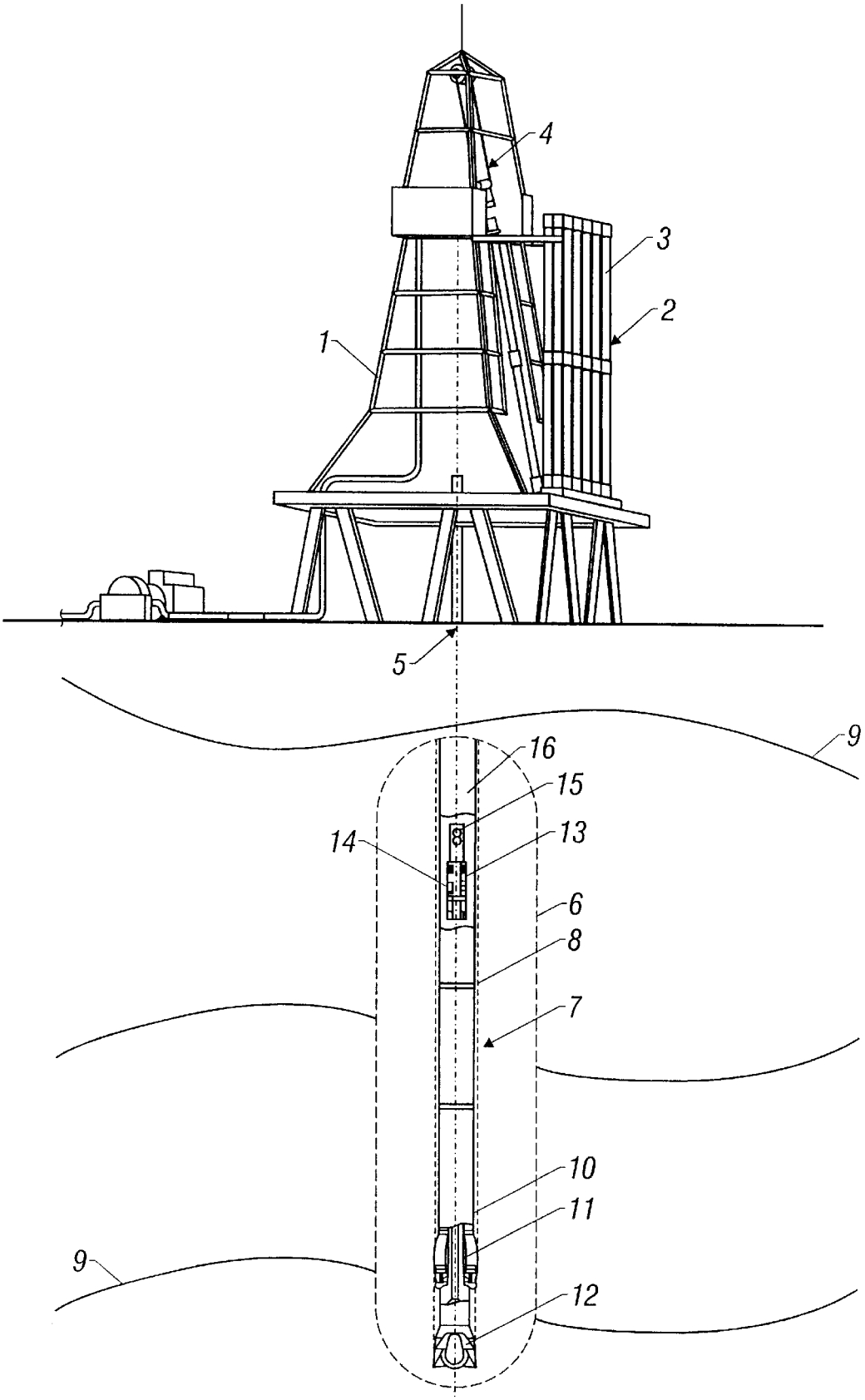
FIG. 1 is an illustration of the invention showing the above ground parts and the downhole device.

As the drawing shows in greater detail, the above-ground portion of the drilling equipment comprises a conventional drilling tower 1 with a stock 2 of rods in which tubular rod parts (drill string segments) 3 of the same and predetermined length are housed. The tubular rod parts 3 are taken from the rod stock 2 by means of a hoist 4 and are screwed into place to become component parts of the drill line 5 to the bottom end ofwhich the drilling tool 7 illustrated diagrammatically in the broken-away part 6 is connected. The drilling tool disposed in the bore hole 5 in the underground formation 9 comprises a housing 10 with, accommodated in this housing, a drive motor (not shown) which drives a drill bit 12 via a drive shaft 11. As the central processor, there is in the housing 10 of the drilling tool 7 a computer 13 which is supplied with measured data acquired underground, the said computer determining the directional pattern of the bore hole, the bore hole profile. A computer 13 comprises a data memory 14 to receive predetermined data and is equipped with a programme which, in addition to other measured data such as the inclination of the axis of the drilling tool, evaluates and processes the switching pulses (signals) of a sensor 15 which responds to variations in the pressure or flow of drilling mud. In the usual manner, these pules are passed from the surface through the drill line 5 and the drilling tool 7 and fed to the drill bit 12, emerging from the drill bit 12 for cooling and flushing purposes and flows back to the surface through the annular space in the bore hole 8.

The sensor is shown only diagrammatically at 15 and, like the computer 13, is disposed in a part of the housing 10 which does not rotate in relation to the drill bit 12.

For depth ascertainment the longitudinal measurement of the tubular pipe parts 3 intended for use is ascertained and fed into the memory 14 of the computer 13 together with the starting depth of the bore hole 8. Before the drilling tool 7 is introduced into the bore hole 8 or upon the starting depth in the bore hole 8 being reached, the computer 13 is ascertained and receives from the sensor 15 pulses which are dependent on an interruption in the flow of drilling mud or which depend upon the pressure drop in the drilling mud, such as are typical of an interruption in the drilling process when a tubular rod part 3 is attached to the drill line 5. From the pulses received by the sensor 15 and while taking into account the data stored in the memory 14, the processing programme of the computer 13 calculates the current depth which is required as a control variable or the underground control of the drilling pattern.

If the computer 13 is in an inactive or deactivated state, a first switching pulse delivered by the sensor 15 causes activation of the computer 13 and in this case the drilling tool 7 is generally disposed on the bottom of a bore hole 8, the starting depth of which is held in the memory 14. By a predetermined coded sequence of switching pulses from the sensor 15, the computer 13 can be changed to a special operating mode and in fact independently of the processing of switching pulses of the sensor 15 which are used for depth ascertainment. Thus, it is for example possible to change the computer to a waiting condition or to supply it with data from the surface and this may for example cause a change of programmed.

The depth value calculated after every use of a tubular rod part 3 is preferably passed by the computer 13 to a direction controlling device 16 in the housing 10 of the drilling tool 7 which is supported in the housing 10 above or below the computer 13 and which causes a pivoting of a bottom tool part comprising, angled over in relation to the central axis through the outer housing 10, a drive shaft 11 for the drilling tool 12, when a change in direction is commanded by the processing programme of the computer 13. Various constructions of directional drilling tools with the direction controlling device integrated into the drilling tool are known (U.S. Pat. Nos. 5,215,151; 5,339,913; 5,311,952) and they do not therefore require to be explained in greater detail here.

I claim:

1. A method for determination of the depth of a well drilled by a bottom hole assembly (BHA), said BHA conveyed on a plurality of drill string segments, into an underground formation, the method comprising:

(a) inputting the length of the drill string segments used in drilling the well and the starting depth of the well into a memory of a computer in the BHA;

(b) using a sensor in the BHA to send a signal to the computer indicative of the number of drill string segments used; and (c) determining in the computer the depth of the well from said number and length of drill string segments and a preprogrammed planned pattern of the well.

2. The method of claim 1 wherein the plurality of segments conveys drilling mud therethrough and the signal is a pulse, the method further comprising using the sensor to send a pulse to the computer when there is a rise or fall in the pressure of the drilling mud or when the drilling mud is switched on or off.

3. The method of claim 1 wherein the computer is turned from an inactive state to an active state by a first signal from the sensor.

4. The method of claim 2 wherein the computer is turned from an inactive state to an active state by a first switching pulse from the sensor.

5. The method of claim 1 wherein a predetermined coded sequence of pulses from the sensor changes the computer to a predetermined operating mode.

6. The method of claim 2 wherein a predetermined coded sequence of pulses from the sensor changes the computer to a predetermined operating mode.

7. The method of claim 3 wherein a predetermined coded sequence of pulses from the sensor changes the computer to a predetermined operating mode.

8. The method of claim 4 wherein a predetermined coded sequence of pulses from the sensor changes the computer to a predetermined operating mode.

9. The method of claim 1 wherein the depth determined after the use of each drill string segment is communicated by the computer to a direction controlling device in the BHA.

10. The method of claim 2 wherein the depth determined after the use of each drill string segment is communicated by the computer to a direction controlling device in the BHA.

11. The method of claim 3 wherein the depth determined after the use of each drill string segment is communicated by the computer to a direction controlling device in the BHA.

12. The method of claim 4 wherein the depth determined after the use of each drill string segment is communicated by the computer to a direction controlling device in the BHA.

13. The method of claim 5 wherein the depth determined after the use of every drill string segment is communicated by the computer to a direction controlling device in the BHA.

14. The method of claim 6 wherein the depth determined after the use of every drill string segment is communicated by the computer to a direction controlling device in the BHA.

15. The method of claim 7 wherein the depth determined after the use of every drill string segment is communicated by the computer to a direction controlling device in the BHA.

16. The method of claim 8 wherein the depth determined after the use of every drill string segment is communicated by the computer to a direction controlling device of the drilling tool.

17. A bottom hole assembly (BHA) conveyed on a plurality of drill strings of predetermined length for drilling a borehole while simultaneously determining the depth of the borehole, the BHA comprising:

(a) a drilling tool;

(b) a sensor responsive to the flow or pressure of drilling mud used for drilling the well and providing signals in response thereto; and (a) a computer for calculating the depth of the well in response to the signals, said predetermined lengths and from preprogrammed instructions.

18. The apparatus of claim 17 wherein the the depth calculated after the use of each drill string segment is communicated by the computer to a direction controlling device of the drilling tool.

* * * * *